United States Patent [19]

Crockett

[11] Patent Number: 4,786,107

[45] Date of Patent: Nov. 22, 1988

[54] LIFTING APPARATUS FOR A SEATING STRUCTURE

[76] Inventor: Foy Crockett, H.C. 79, Box 578, Hugo, Okla. 74743

[21] Appl. No.: 927,815

[22] Filed: Nov. 6, 1986

[51] Int. Cl.[4] ..... A47C 1/02

[52] U.S. Cl. ..... 297/330; 297/DIG. 10; 297/347

[58] Field of Search ..... 297/330, DIG. 10, 347; 254/124, 9 C, 8 C; 248/421

[56] References Cited

U.S. PATENT DOCUMENTS

| | | | |
|---|---|---|---|
| 2,821,242 | 1/1958 | Manegold | 297/339 |
| 2,940,769 | 6/1960 | Taylor | 254/9 C |
| 3,006,594 | 10/1961 | Gruendler | 248/396 X |
| 3,123,400 | 3/1964 | Paulson | 297/314 |
| 3,138,402 | 6/1964 | Heyl, Jr. et al. | 297/69 |
| 3,472,488 | 10/1969 | Naughton | 254/122 |
| 3,596,982 | 8/1971 | Grams | 297/71 |
| 3,765,720 | 10/1979 | Sakai | 297/330 |
| 3,865,347 | 2/1975 | Pase | 254/124 |
| 4,083,599 | 4/1978 | Gaffney | 297/131 |
| 4,448,382 | 5/1984 | Melone | 248/421 |
| 4,541,134 | 9/1985 | Black et al. | 297/330 |

*Primary Examiner*—James T. McCall

*Attorney, Agent, or Firm*—Laney, Dougherty, Hessin & Beavers, Inc.

[57] ABSTRACT

An apparatus for elevating and lowering a freestanding seating structure, such as a house chair, recliner, or sofa. The apparatus is comprised of a base, an elevator assembly, a power assembly connected between the base and the elevator assembly, and a control assembly. The elevator assembly releasably receives, supports, elevates and lowers the seating structure. The power assembly provides power and supportingly moves the elevator assembly. The control assembly controls the power assembly and the position of the elevator assembly relative to the base. The invention also includes riser arms which are pivotally connected between the base and the elevator assembly for structurally supporting and stabilizing the elevator assembly.

19 Claims, 5 Drawing Sheets

LIFTING APPARATUS FOR A SEATING STRUCTURE

BACKGROUND OF THE INVENTION

This invention relates to lifting apparatus and more particularly relates to a lifting apparatus which may be used to elevate and lower chairs and furniture.

Elevatable chairs have been known in the art for quite some time, as have elevators and powered lifting devices. For example dentist's chairs, barber's and beautician's chairs, elevatable invalid's chairs, and building elevators have been in common use for many years.

A shortcoming in the elevatable chairs and lifting devices known in the art is that a person can not attach a conventional chair to the known lifting devices for everyday home use. For example, partially disabled persons who can not lower or raise themselves from a conventional chair have no lifting device available which will adapt to their favorite conventional chair and must purchase an expensive integral chair lifting device assembly.

SUMMARY OF THE INVENTION

Accordingly, it is an object of this invention to provide a relatively inexpensive lifting apparatus which can be releasably attached to and used to lift and lower conventional structures, such as chairs, sofas, recliners, etc.

The lifting apparatus of the present invention includes a base, an elevator means, power means, and control means. The elevator means is used for releasably receiving, supporting, elevating, and lowering an entire freestanding structure of a house chair, recliner, sofa, etc. The power means is connected between the base and the elevator means and is used for providing power and for supportingly moving the elevator means between a lowered position and an elevated position relative to the base. The control means is used for controlling the power means and the position of the elevator means relative to the base.

The lift apparatus may also include riser arm means which are pivotally engaged between the base and the elevator means. The riser arm means cooperate with the power means to support and lift the elevator means. The riser arm means move the elevator means towards the front of the base and lift the rear of the elevator means more than the front of the elevator means as the elevator means is lifted in order to allow easy access to a chair on the elevator means. The riser arm means and elevator means also retract within the plane of the base in the lowered position of the elevator means to minimize the effect of the lowered lift apparatus on the height of the attached seat.

BRIEF DESCRIPTION OF THE DRAWINGS

The present invention will be better understood by reference to the examples of the following drawings.

DETAILED DESCRIPTION OF THE PREFERRED EMBODIMENTS

Before explaining the present invention in detail, it is to be understood that the invention is not limited to the details of construction and arrangement of parts illustrated in the accompanying drawings, since the invention is capable of other embodiments and of being practiced or carried in various ways commensurate with the claims herein. Also, it is to be understood that the terminology employed herein is for the purpose of description and not of limitation.

Figure 1:
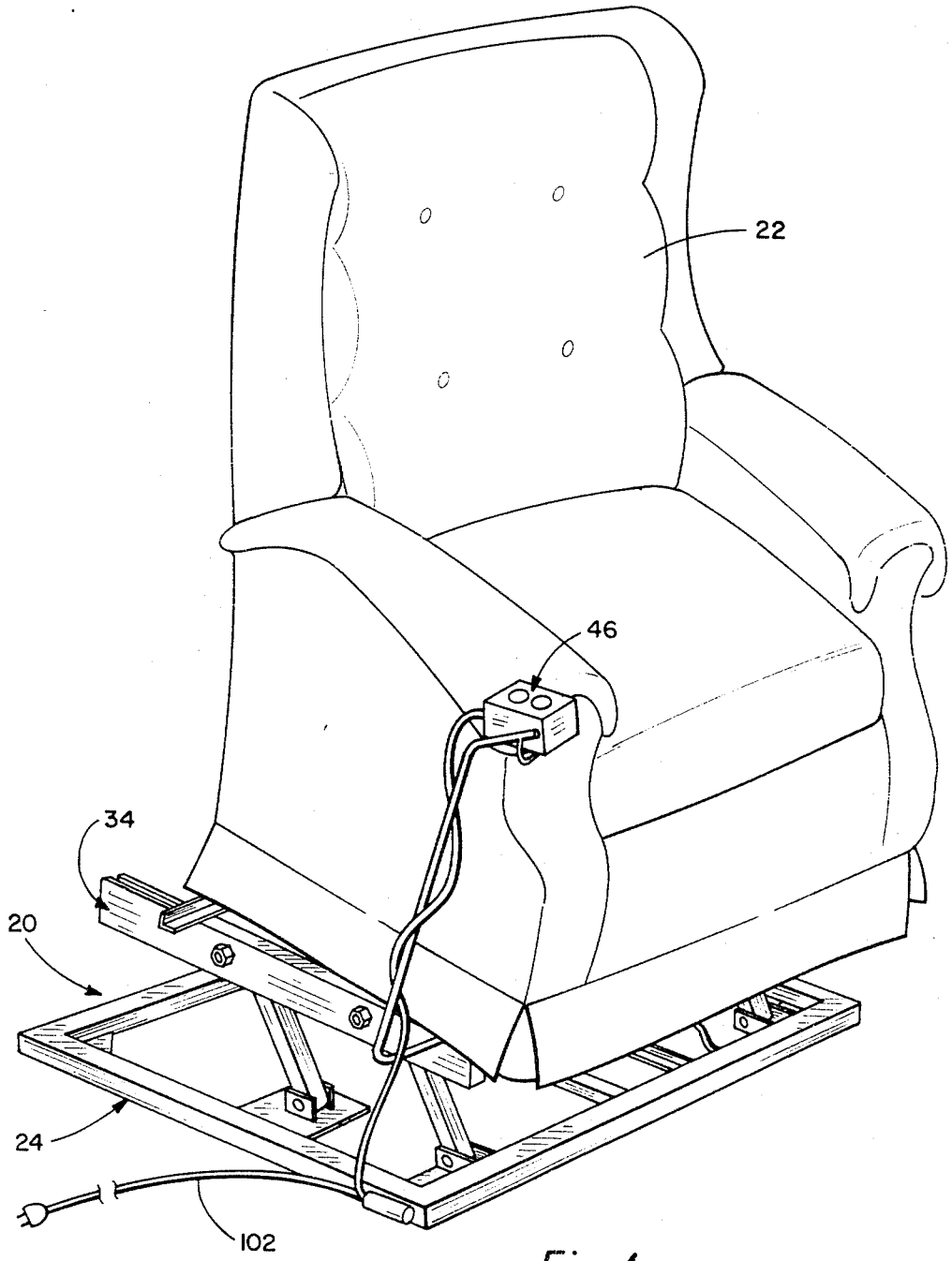
FIG. 1 is a perspective view of an embodiment of the lifting apparatus of the present invention with a rocking chair releasably attached thereto.

FIG. 1 presents one embodiment of a lift apparatus, generally designated 20, for elevating and lowering a seating structure 22 such as a house chair, recliner, sofa, etc. Referring also to the example of FIG. 2, it is seen that the lift apparatus 20 may be described as being generally comprised of a base 24 having a front 26, a rear 28, and two sides 30, 32; an elevator means 34 having a front 36, rear 38, and two sides 40, 42 which are oriented in correspondence with the like-named features of the base 24; a power means 44; and control means 46 (best seen in FIG. 1).

The elevator means 34 is used for releasably receiving, supporting, elevating, and lowering an entire freestanding seating structure 22, such as a house chair, recliner, sofa, or any similar piece of furniture. The seating structure 22 illustrated in FIG. 1 is a rocking chair and is depicted in a "rocked foward" position to reveal as much as possible of the lift apparatus 20. The lift apparatus 20 and elevator means 34 may be easily modified to accept virtually any size furniture by simply increasing or decreasing the size and/or strength of the lift 20.

Figure 2:
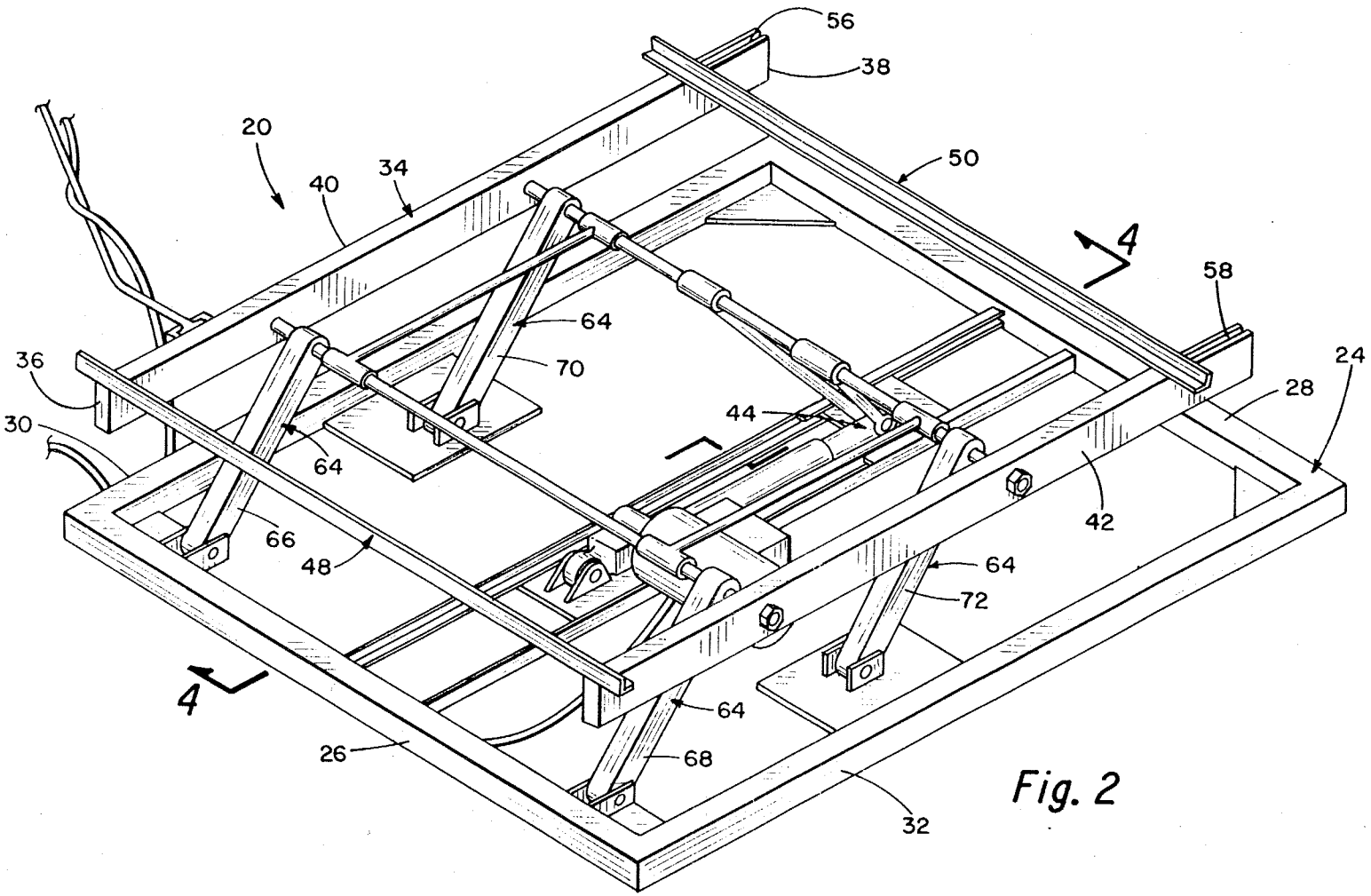
FIG. 2 is a perspective view of an embodiment of the lifting apparatus of the present invention.

Referring to example FIG. 2, the elevator means 34 may further include attachment means 48, 50 for releasably securing the seating structure 22 to the elevator means 34. As exemplified in FIG. 2, the attachment means 48, 50 may be as simple as a front bracket (also designated 48) and rear bracket (also designated 50) which receive the feet or base of the seating structure 22. The rear bracket 50 slides in the slots 56, 58 in order to adjust to accommodate various sizes of furniture or seating structures 22. Referring to example FIG. 3, bolts 60, 62 are provided to secure the rear bracket 50 in position and thereby to secure the seating structure 22 to lift the apparatus 20 once the rear bracket has been adjusted to fit the seating structure. The bolts 60, 62 may be replaced with spring loaded pins, mechanical pins, or equivalent mechanical fasteners. The attachment means 48, 50 may be replaced with clips, straps, bands, bolts, screws, etc. to accommodate a particular seating structure's 22 or user's requirements.

The attachment means 48, 50 of the example embodiment may also serve to properly orient the seating structure 22. As seen in FIG. 2, the front bracket 48 of the attachment means 48, 50 may be located at the front edge 36 of the elevator means 34 in order to allow the seating structure to be positioned as far forward on the lift 20 as possible to allow entry or access to the seating structure 22 with as little obstruction by the lift 20 as possible.

Figure 6:
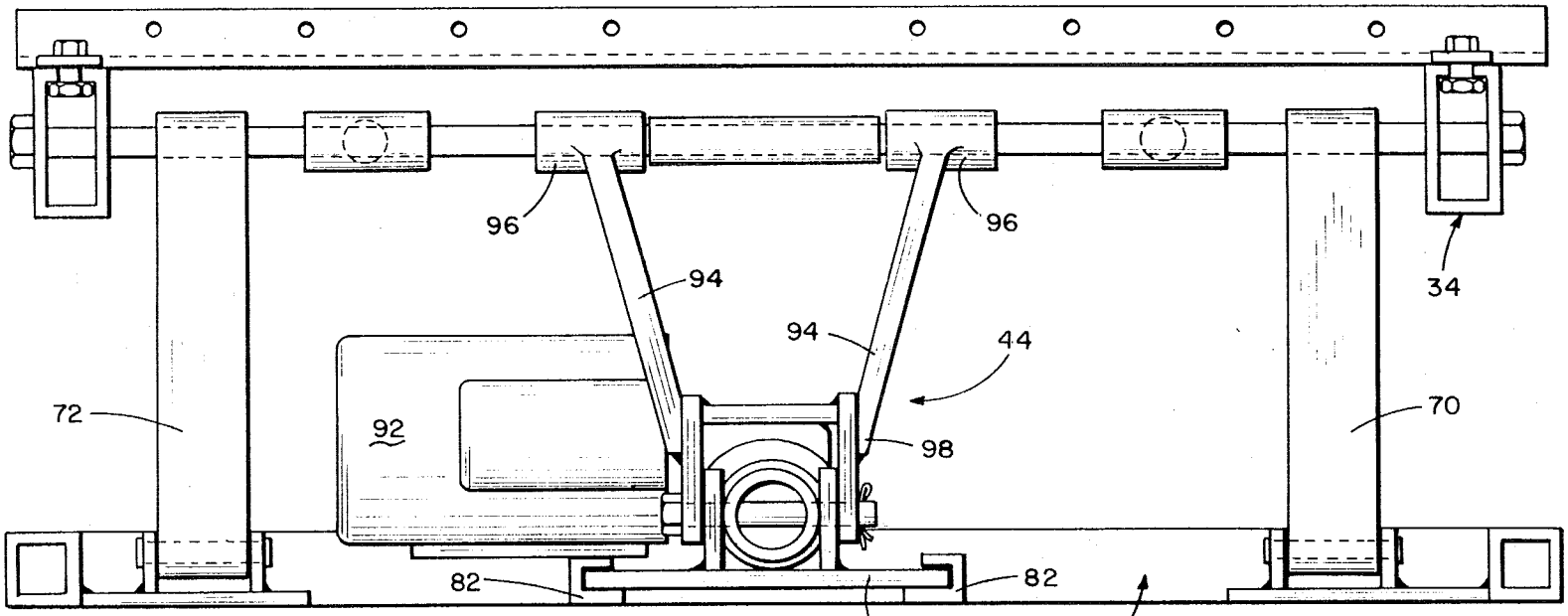
FIG. 6 is a sectional view taken along line 6—6 of FIG. 4.

As best seen in FIG. 6, the power means 44 is connected between the base 24 and the elevator means 34 for supportingly moving the elevator means 34 between a lowered position and an elevated position relative to the base 24. The power means 44 may comprise any form of electrically, pneumatically, or hydraulically powered lifting mechanism which will structurally support as well as elevate and lower the elevator means 34 and seating structure 22.

The control means 46 is used for controlling the power provided by the power means 44 and for controlling the position of the elevator means 34 relative to the base 24.

Figure 4:
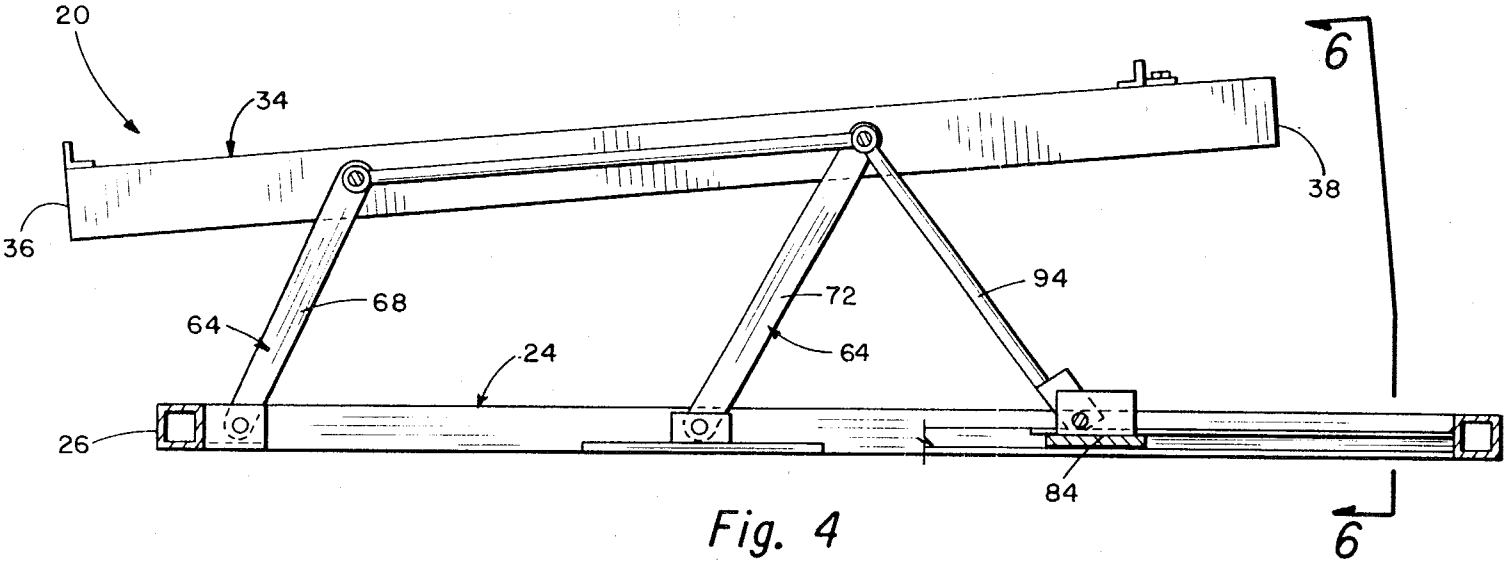
FIG. 4 is a sectional view along line 4—4 of FIG. 2.
Figure 5:
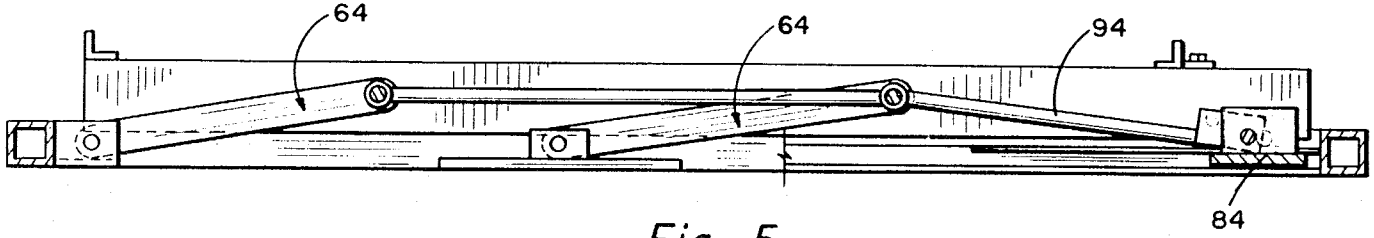
FIG. 5 is a sectional view taken along line 5—5 of FIG. 3.

Referring to FIGS. 4 and 5, in the example embodiment the lift apparatus 20 may also include riser arm means 64 having one end pivotally engaged with the base 24 and the other end pivotally engaged with the elevator means 34 for structurally supporting and stabilizing the elevator means 34 and for distributing the forces of the elevator means 34 on the base 24. The pivotal engagements of the riser arm means 64 with the base 24 and elevator means 34 are oriented such that the riser arm means 64 pivots to form a smaller angle with the plane of the base 24 as the elevator means 34 is lowered (best seen in FIG. 5) and the riser arm means 64 pivots to form a larger angle with the plane of the base 24 as the elevator means 34 is elevated (best seen in FIGURE 4). Also, as illustrated in the example embodiment of FIG. 4, riser arm means 64 pivots towards the front 36 of the elevator means 34 and the front 26 of the base 24 as the elevator means 34 is elevated, thereby moving the elevator means 34 towards the front of the base as the elevator means is elevated. This feature makes the use of the lift apparatus more comfortable, that is, the forward motion of the elevated elevator means moves the seating structure 22 over the front 26 of the base 24 and minimizes the obstruction the base presents to a person entering or exiting the elevated seating structure 22.

In order to provide good structural support and stability for the elevator means 34, in the example embodiment, as illustrated in FIG. 2, the riser arm means 64 comprises four riser arms, 66, 68, 70, 72 with two of the riser arms being positioned near each side of the elevator means 26. Although adequate structural support and stability may be provided with two riser arms, one of the two riser arms being positioned near each side 40, 42 of the elevator means 34, by providing four riser arms 66, 68, 70, 72 with two of the riser arms 66, 68, 70, 72 positioned near each side 30, 32 of the base 24 and elevator means 26 and making the two riser arms 70, 72 nearest the rear 38 of the elevator means 34 longer than the two riser arms 66, 68 nearest the front 36 of the elevator means 34 the rear 38 of the elevator means 34 is elevated more than the front 36 of the elevator means 34 as the elevator means is elevated (best seen in FIG. 4). This feature tilts the elevated elevator means 34 and seating structure 22 towards the front of the lift apparatus 20, as illustrated in FIGS. 1 and 4, which makes the elevated seating structure 22 easier to enter and exit, particularly by a partially disabled person. In the example of FIG. 2, the four riser arms 66, 68, 70, 72 are positioned to define the four corners of a rectangle, although this is not essential to the operation of the lift apparatus 20, i.e., the riser arms 66, 68, 70, 72 may be positioned as required or desired for a specific application and the length of the arms may be adjusted to achieve the desired elevation and angle or tilt of the elevator means 34.

Figure 3:
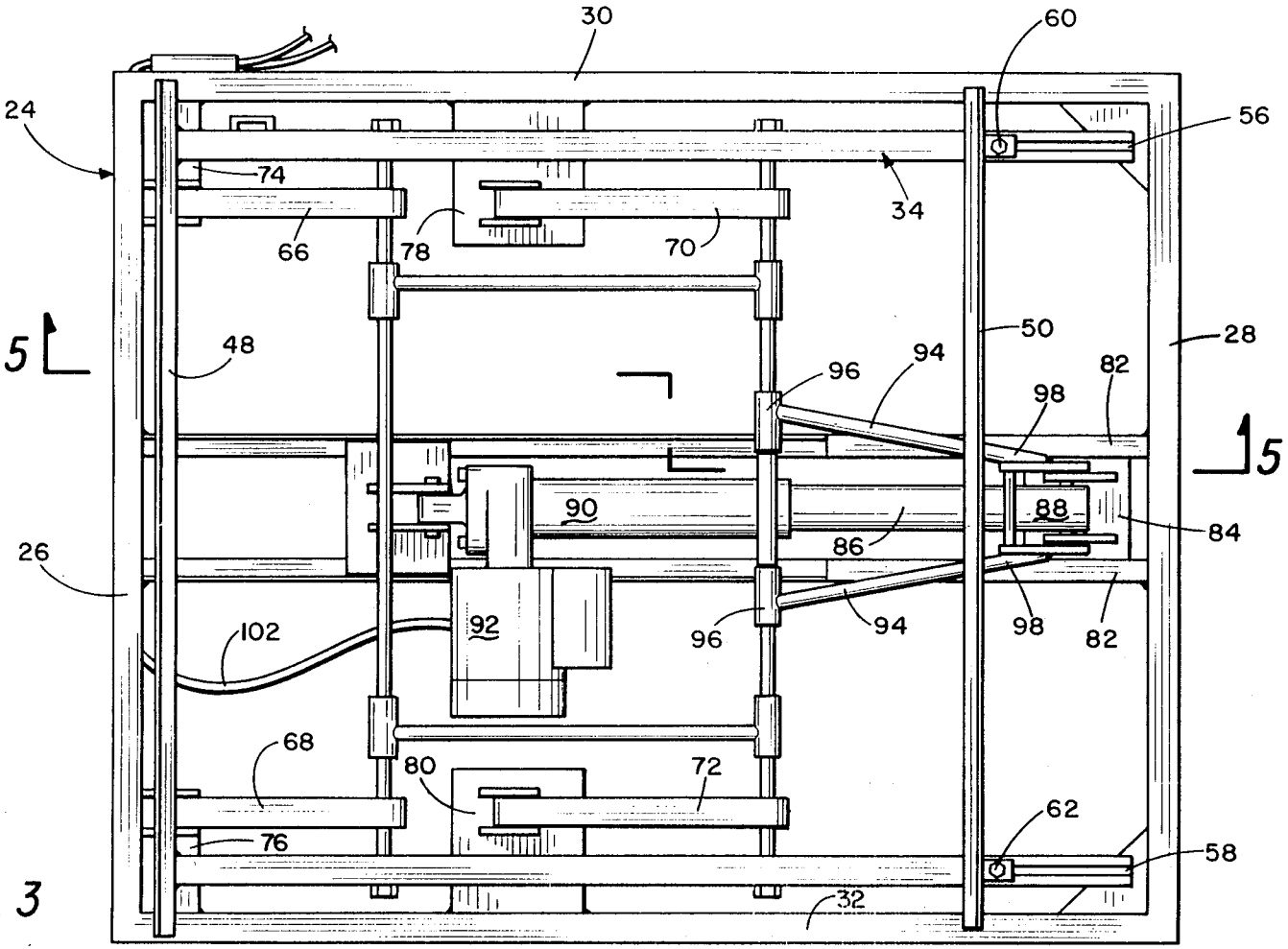
FIG. 3 is a plan view of the embodiment of FIG. 1 with the lift apparatus being in the lowered position.

Referring to example FIG. 3, the riser arms 66, 68, 70, 72 and the elevator means 34 are inset within the perimeter defined by the front 26, rear 28, and sides 30, 32 of the base 24. Also, the riser arms 66, 68, 70, 72 are pivoted at their lower ends from pivot plates 74, 76, 78, 80 within the plane of the base 24. This allows the elevator means 34 to retract within the plane of the base 24 in the lowered position of the elevator means 34 (best seen in FIG. 5). This feature minimizes the effect of the lowered lift apparatus 20 on the height of the seating structure 22.

Referring to example FIGS. 3 and 6, the power means 44 may comprise: a slideway 82 secured to the base 24; a slide 84 slidingly engaging the slideway 82; a ram 86 having a first end 88 pivotally engaged with the slide 84 and having a second end 90; a power source means 92 engaged with the second end 90 of the ram 86, for drivingly extending and retracting the ram 86 and slide 84; and at least one lifting arm 94, having a first end 96 pivotally engaged with the elevator means 34 and a second end 98 pivotally engaged with the slide 84. The lifting arm 94 pivots to form a smaller angle with the base 24 as the ram 86 and slide 84 are extended thereby lowering the elevator means 34 (best seen in FIG. 5). The lifting arm 94 pivots to form a larger angle with the base 24 as the ram 86 and slide 84 are retracted, thereby elevating the elevator means 34 (best seen in FIG. 4). The lifting arm 94 transposes the horizontal sliding force imparted to the slide 84 by the power source means 92 into a vertical motion which pivotally lifts or lowers the elevator means 34 about the pivotal engagement of the riser arms 66, 68, 70, 72 with the base 24 and elevator means 34. This transposition of motion is facilitated by the relative orientations of the lifting arm 94 and riser arm means 64, i.e., the axes about which the lifting arm 74 and riser arms 66, 68, 70, 72 pivot are parallel and the longitudinally axial plane of the lifting arm 74, the longitudinally axial plane of the riser arm means 52 or any one of the riser arms 54, 56, 58, 60, and the plane of the base form a triangle. These relative orientations, together with the longer length of the two riser arms 70, 72 nearest the rear of the elevator means 34 place the elevator means 34 in a plane generally parallel with the plane of the base in the lowest elevation of the elevator means 34 and also elevate the rear 38 of the elevator means more than the front 36 of the elevator means as the elevator means is elevated.

The prototype lift apparatus 20 utilizes a reversible electric motor as the power source means 92 with an Acme threaded shaft to drive the ram 86. The electric motor 92 is controlled by control means 46, which is an electric switch (also designated 46) connected into the power wiring 102 to the motor 92. The switch 46 can stop or start the movement of the elevator means 34 in either direction, up or down, at any point in the range of travel of the elevator means 34. The motor 92 also serves as a brake mechanism, that is, when switch 46 is deactivated the motor is dead and, together with the Acme threaded shaft, locks the slide 82 and lifting arm 94 and therefore the elevator means 34 and seating structure 22 into the elevation at which the switch was deactivated.

While the invention has been described to a certain degree to particularity it is manifest that many changes may be made in details of construction and the arrangement of components without departing from the spirit and scope of this disclosure. It is understood that the invention is not limited to the embodiments set forth herein for purposes of exemplification, but is to be limited only by the scope of the attached claim or claims including the full range of equivalency to which each element thereof is entitled.

What is claimed is:

1. An apparatus for elevating and lowering a freestanding seating structure, such as a house chair, recliner, or sofa, the freestanding seating structure having an understructure or legs for contacting a generally planar surface, such as a floor, the understructure supporting the seating surface of the freestanding seating structure in a position spaced away from the planar surface, comprising:

a base having a front, a rear, and two sides;

an elevator means for releasably receiving, supporting, elevating, and lowering the freestanding seating structure without addition to or modification of the freestanding seating structure, the elevator means having a front, a rear, and two sides oriented in correspondence with the like-named features of the base;

power means, connected between the base and the elevator means, for providing power and for supportingly moving the elevator means between a lowered position and an elevated position relative to the base; and control means for controlling the power means and for controlling the position of the elevator means relative to the base, the control means being accessible to and operable by an occupant of the seating structure.

2. The apparatus of claim 1, further comprising:

riser arm means, having one end pivotally engaged with the base and the other end pivotally engaged with the elevator means, for structurally supporting and stabilizing the elevator means and for distributing the forces of the elevator means on the base; and wherein the riser arm means pivots to form a smaller angle with the plane of the base as the elevator means is lowered and the riser arm means pivots to form a larger angle with the plane of the base as the elevator means is elevated.

3. The apparatus of claim 2 in which the power means further comprises:

a slideway secured to the base;

a slide slidingly engaging the slideway;

a ram having a first end pivotally engaged with the slide and having a second end;

a power source means, engaged with the second end of the ram, for drivingly extending and retracting the ram and slide;

a lifting arm, having a first end pivotally engaged with the elevator means and a second end pivotally engaged with the slide; and wherein the lifting arm pivots to form a smaller angle with the base as the ram and slide are extended thereby lowering the elevator means, and the lifting arm pivots to form a larger angle with the base as the ram and slide are retracted thereby elevating the elevator means.

4. The apparatus of claim 3:

wherein the longitudinally axial plane of the lifting arm, the longitudinally axial plane of the riser arm means, and the plane of the base form a triangle.

5. The apparatus of claim 2:

wherein the riser arm means is further defined as pivoting towards the front of the elevator means and the front of the base as the elevator means is elevated, thereby moving the elevator means towards the front of the base as the elevator means is elevated.

6. The apparatus of claim 2 in which the riser arm means is further defined as comprising:

at least two riser arms, at least one of the riser arms positioned near each side of the elevator means.

7. The apparatus of claim 2 in which the riser arm means is further defined as comprising:

four riser arms, two of the riser arms positioned near each side of the elevator means.

8. The apparatus of claim 7:

wherein the two riser arms nearest the rear of the elevator means are longer than the two riser arms nearest the front of the elevator means in order to elevate the rear of the elevator means more than the front of the elevator means as the elevator means is elevated.

9. The apparatus of claim 1 in which the elevator means further comprises:

attachment means for releasably securing the seating structure to the elevator means.

10. The apparatus of claim 1:

wherein the front, rear, and two sides of the base generally define a plane of the base; and wherein the lowered position of the elevator means is within the plane of the base.

11. The apparatus of claim 1:

wherein the front, rear, and two sides of the base generally define a plane of the base; and wherein the elevator means is in a plane generally parallel with the plane of the base in the lowest elevation of the elevator means; and wherein the rear of the elevator means is elevated more than the front of the elevator means as the elevator means is elevated.

12. An apparatus for elevating and lowering a freestanding seating structure, such as a house chair, recliner, or sofa, the freestanding seating structure having an understructure or legs for contacting a generally planar surface, such as a floor, the understructure supporting the seating surface of the freestanding seating structure in a position spaced away from the planar surface, comprising:

a base having a front, a rear, and two sides;

an elevator means for releasably receiving, supporting, elevating, and lowering the entire seating structure without addition to or modification of the freestanding seating structure, the elevator means having a front, a rear, and two sides oriented in correspondence with the like-named features of the base;

power means, connected between the base and the elevator means, for providing power and for supportingly moving the elevator means between a lowered position and an elevated position relative to the base; and attachment means for releasably securing the seating structure to the elevator means; and control means for controlling the power means and for controlling the position of the elevator means relative to the base.

13. An apparatus for elevating and lowering an entire freestanding seating structure, such as a house chair, recliner, or sofa, comprising:

a base having a front, a rear, and two sides;

an elevator means for releasably receiving, supporting, elevating, and lowering the entire seating structure, the elevator means having a front, a rear and two sides oriented in correspondence with the like-named features of the base;

a slideway coplanarly secured to the base;

a slide slidingly engaging the slideway;

a ram having a first end pivotally engaged with the slide and having a second end;

a power source means, engaged with the second end of the ram, for drivingly extending and retracting the ram and slide;

a lifting arm, having a first end pivotally engaged with the elevator means and a second end pivotally engaged with the slide, the lifting arm pivoting to form a smaller angle with the base as the ram and slide are extended, thereby lowering the elevator means; the lifting arm pivoting to form a larger angle with the base as the ram and slide are retracted, thereby elevating the elevator means;

four riser arms, two of the riser arms positioned near each side of the elevator means, each of the riser arms having one end pivotally engaged with the base and the other end pivotally engaged with the elevator means, each of the riser and arms pivoting to form a smaller angle with the plane of the base as the elevator means is lowered, each of the riser arms pivoting to form a larger angle with the plane of the base as the elevator means is elevated, each of the riser arms pivoting towards the front of the elevator means and the front of the base as the elevator means is elevated thereby moving the elevator means towards the front of the base as the elevator means is elevated, the two riser arms nearest the rear of the elevator means being longer than the other two riser arms in order to elevate the rear of the elevator means more than the front edge of the elevator means as the elevator means is elevated, the longitudinally axial plane of any one of the lifting arms forming a triangle with the longitudinally axial plane of the lifting arm and the plane of the base;

attachment means for releasably securing the seating structure to the elevation means with the entry to the seating structure facing the front of the elevation means; and control means for controlling the power means and for controlling the position of the elevator means relative to the base.

14. An apparatus for elevating and lowering a freestanding seating structure, such as a house chair, recliner, or sofa, the freestanding seating structure having an understructure or legs for contacting a generally planar surface, such as a floor, the understructure supporting the seating surface of the freestanding seating structure in a position spaced away from the planar surface, comprising:

a base having a front, a rear, and two sides;

an elevator means for releasably receiving, supporting, elevating, and lowering the freestanding seating structure without addition to or modification of the freestanding seating structure, the elevator means having a front, a rear, and two sides oriented in correspondence with the like-named features of the base;

power means, connected between the base and the elevator means, for providing power and for supportingly moving the elevator means between a lowered position substantially within the plane of the base and an elevated position above the base; and control means for controlling the power means and for controlling the position of the elevator means relative to the base.

15. An apparatus for elevating and lowering a freestanding seating structure, such as a house chair, recliner, or sofa, the freestanding seating structure having an understructure or legs for contacting a generally planar surface, such as a floor, the understructure supporting the seating surface of the freestanding seating structure in a position spaced away from the planar surface, comprising:

a base having a front, a rear, and two sides which generally define a plane of the base;

an elevator means for releasably receiving, supporting, elevating, and lowering the freestanding seating structure without addition to or modification of the freestanding seating structure, the elevator means having a front, a rear, and two sides oriented in correspondence with the like-named features of the base;

power means, connected between the base and the elevator means, for providing power and for supportingly moving the elevator means between a lowered position and an elevated position relative to the base; and control means for controlling the power means and for controlling the position of the elevator means relative to the base; and wherein the elevator means is in a plane generally parallel with the plane of the base in the lowest elevation of the elevator means; and wherein the rear of the elevator means is elevated more than the front of the elevator means as the elevator means is elevated.

16. An apparatus for elevating and lowering a freestanding structure, such as a house chair, recliner, or sofa, comprising;

a base having a front, a rear, and two sides;

an elevator means for releasably receiving, supporting, elevating, and lowering the freestanding seating structure, the elevator means having a front, a rear, and two sides oriented in correspondence with the like-named features of the base;

power means, connected between the base and the elevator means, for providing power and for supportingly moving the elevator means between a lowered position and an elevated position relative to the base;

control means for controlling the power means and for controlling the position of the elevator means relative to the base;

riser arm means, having one end pivotally engaged with the base and the other end pivotally engaged with the elevator means, for structurally supporting and stabilizing the elevator means and for distributing the forces of the elevator means on the base, the riser arm means pivoting to form a smaller angle with the plane of the base as the elevator means is lowered and the riser arm means pivoting to form a larger angle with the plane of the base as the elevator means is elevated;

a slideway secured to the base;

a slide slidingly engaging the slideway;

a ram having a first end pivotally engaged with the slide and having a second end;

a power source means, engaged with the second end of the ram, for drivingly extending and retracting the ram and slide; and a lifting arm, having a first end pivotally engaged with the elevator means and second end pivotally engaged with the slide, the lifting arm pivoting to form a smaller angle with the base as the ram and slide are extended thereby lowering the elevator means, and the lifting arm pivoting to form a larger angle with the base as the ram and slide are retracted thereby elevating the elevator means.

17. The apparatus of claim 16;

wherein the longitudinally axial plane of the lifting arm, the longitudinally axial plane of the riser arm means, and the plane of the base form a triangle.

18. An apparatus for elevating and lowering a freestanding seating structure, such as a house chair, recliner, or sofa, comprising:

a base having a front, a rear, and two sides;

an elevator means for releasably receiving, supporting, elevating, and lowering the freestanding seating structure, the elevator means having a front, a rear, and two sides oriented in correspondence with the like-named features of the base;

power means, connected between the base and the elevator means, for providing power and for supportingly moving the elevator means between a lowered position and an elevated position relative to the base;

control means for controlling the power means and for controlling the position of the elevator means relative to the base; and riser arm means, having one end pivotally engaged with the base and the other end pivotally engaged with the elevator means, for structurally supporting and stabilizing the elevator means and for distributing the forces of the elevator means on the base, the riser arm means pivoting to form a smaller angle with the plane of the base as the elevator means is lowered and the riser arm means pivoting to form a larger angle with the plane of the base as the elevator means is elevated, the riser arm means pivoting towards the front of the elevator means and the front of the base as the elevator means is elevated, thereby moving the elevator means towards the front of the base as the elevator means is elevated.

19. An apparatus for elevating and lowering a freestanding seating structure, such as a house chair, recliner, or sofa comprising:

a base having a front, a rear, and two sides;

an elevator means for releasably receiving, supporting, elevating, and lowering the freestanding seating structure, the elevator means having a front, a rear, and two sides oriented in correspondence with the like-named features of the base;

power means, connected between the base and the elevator means, for providing power and for supportingly moving the elevator means between a lowered position and an elevated position relative to the base;

control means for controlling the power means and for controlling the position of the elevator means relative to the base; and four riser arms, two of the riser arms positioned near each side of the elevator means, each riser arm having one end pivotally engaged with the base and the other end pivotally engaged with the elevator means, for structurally supporting and stabilizing the elevator means and for distributing the forces of the elevator means on the base, the two riser arms nearest the rear of the elevator means being longer than the two riser arms nearest the front of the elevator means in order to elevate the rear of the elevator means more than the front of the elevator means as the elevator means is elevated, the riser arms pivoting to form a smaller angle with the plane of the base as the elevator means is lowered and the riser arms pivoting to form a larger angle with the plane of the base as the elevator means is elevated.

* * * * *

UNITED STATES PATENT AND TRADEMARK OFFICE

CERTIFICATE OF CORRECTION

PATENT NO. : 4,786,107

DATED : November 22, 1988

INVENTOR(S) : Foy Crockett

It is certified that error appears in the above—identified patent and that said Letters Patent is hereby corrected as shown below:

Column 2, line 51, change "to lift the apparatus" to --to the lift apparatus--.

Signed and Sealed this

Thirty-first Day of October, 1989

*Attest:*

DONALD J. QUIGG

*Attesting Officer*

*Commissioner of Patents and Trademarks*